United States Patent [19]

Sartorius

[11] 3,976,238

[45] Aug. 24, 1976

[54] AIR-COOLED REFRACTORY GUIDE TUBE FOR A METALLURGICAL FURNACE

[75] Inventor: Guy Sartorius, Ban-Saint-Martin, France

[73] Assignee: Societe des Aciers Fins de l'Est, Boulogne-Billancourt, France

[22] Filed: July 9, 1974

[21] Appl. No.: 486,792

[30] Foreign Application Priority Data

July 17, 1973 France ..... 73.26218

[52] U.S. Cl. ..... 266/99; 266/265; 266/287; 73/343 B

[51] Int. Cl.[2] ..... C21C 5/46

[58] Field of Search ..... 73/343 R, 343 B; 266/34 R, 1 R

[56] References Cited

UNITED STATES PATENTS

| | | | |
|---|---|---|---|
| 3,091,119 | 5/1963 | Fischer et al. | 266/1 R X |
| 3,264,874 | 8/1966 | Fischer | 73/343 R |
| 3,330,645 | 7/1967 | DeMoustier et al. | 75/60 |
| 3,598,380 | 8/1971 | Jilek et al. | 266/1 R |
| 3,608,880 | 9/1971 | Gombert et al. | 266/41 X |
| 3,610,045 | 10/1971 | Shearman | 73/343 B |
| 3,774,441 | 11/1973 | Dorst et al. | 73/343 R X |

*Primary Examiner*—Roy Lake
*Assistant Examiner*—Paul A. Bell
*Attorney, Agent, or Firm*—Beveridge, De Grandi, Kline & Lunsford

[57] ABSTRACT

An air-cooled refractory guide tube for insertion in the wall of a metallurgical furnace to permit reciprocal movement of an elongated rod-shaped member into and out of the interior of the furnace through a central orifice extending through the tube. The guide tube consists of a metal part and a refractory part, with the metal part including means for directing compressed air through the central orifice of the refractory part and for independently directing air through a series of cooling orifices extending through the ceramic part. Upon the ceramic part being consumed in use, the metal part can be reused. By controlling the rate of flow of cooling air through the ceramic part, its melting rate can be kept equal to that of the furnace wall.

4 Claims, 2 Drawing Figures

AIR-COOLED REFRACTORY GUIDE TUBE FOR A METALLURGICAL FURNACE

BACKGROUND OF THE INVENTION

1. Field of the Invention

The invention relates to a refractory guide tube adapted to be inserted in the wall of a metallurgical furnace.

2. Description of the Prior Art

Metallurgical furnaces of the type with which this invention is used have apertures through which the furnace interior can be inspected or samples of metal or slag can be withdrawn during an operation, or the temperature of the metal or slag can be measured (either continuously or not) and the furnace atmosphere can be measured. For example, continuous measurements can be made of the temperature of a metallurgical furnace in the manner disclosed in U.S. Pat. No. 3,786,161 and U.S. Pat. application Ser. No. 369,356 in the name of the present applicant. Rod-shaped measuring and observation devices are inserted through the apertures and can slide in refractory guide tubes provided in the thickness of the furnace wall.

The known refractory guide tubes are solid and do not usually wear at the same rate as the adjacent surface of the furnace wall in which it is inserted. When the refractory guide tube melts more slowly than the furnace wall, the end of the tube projects into the interior of the furnace and various material, more particularly scrap, may fall on it. Consequently, the measuring instruments are not protected in that end of the guide tube which projects inside the furnace.

On the other hand, if the refractory guide tube melts more quickly than the furnace wall, the end of the tube inside the furnace has a funnel-shaped opening. This results in two disadvantages. Firstly, the end of the measuring rod receives lateral radiation in the funnel, in addition to frontal radiation. Secondly, the funnel makes it more difficult to clean the end of the measuring rod. Spattered liquid metal or slag solidify on the rod and cannot be loosened, so that the rod jams during the withdrawal movement. Furthermore, the end of the rod becomes clogged, thus reducing its thermal sensitivity.

As is known, the refractory material forming the guide tube can be selected so as to have a melting temperature approximately the same as that of the furnace wall. In such cases, however, it is usually found that the guide tube tends to melt more quickly than the wall at the beginning of the operation and more slowly at the end of the operation.

SUMMARY OF THE INVENTION

The refractory guide tube according to this invention becomes worn at the same rate as the furnace wall and comprises means for cleaning the measuring rod during the withdrawal movement thereof. Furthermore, the refractory guide tube can be partly reused.

According to the invention, the refractory guide tube in which the measuring rod slides has compressed air-cooling means and comprises a metal part and a refractory part. The metal part is a casing comprising thin metal tubes which longitudinally extend through the refractory part. Consequently, a first blow-out can be performed in the thin metal tubes embedded in the thickness of the refractory part of the tube. The first blow-out, which eliminates practically all the furnace slag which has adhered to the tube, should be adjustable so that the refractory tubes wears out at the same rate as the wall, i.e., the applied pressure sould be greater at the beginning, to prevent the refractory from melting quicker than the wall and producing a funnel which does not have clean edges, thus interferring with slag removal and exposing the rod to lateral radiation in addition to frontal radiation. At the end of the operation, the applied blow-out pressure should be lower, to prevent the refractory part of the tube from being excessively cooled and projecting from the wall, so that it is exposed to falling scrap. The blow-out pressures required during an operation can be experimentally determined once and for all. To this end, for example, the blow-out pressure may be adjusted while inspecting the end of the refractory guide tube which is in the furnace, to see that it wears at the same rate as the wall.

A second blow-out operation is performed in the clearance between the refractory part of the tube and the rod sliding in it. The second blow-out solidifies or "quenches" splattered slag on the end of the rod at the furnace-side outlet, and should prevent light slag from reaching the rod. Slag removal is therefore greatly facilitated, since the fragile solidified slag breaks when pressed by the rod tip.

The metal casing of the refractory guide tube has two chambers. The aforementioned thin metal tubes communicate with a first chamber in the casing, which is connected to a compressed air installation. The casing also has a second chamber communicating with the clearance between the refractory part of the tube and the measuring rod, which slides therein. The second chamber is likewise connected to a compressed air installation.

BRIEF DESCRIPTION OF THE DRAWING

The invention will be more clearly understood from the following description of a non-limitative embodiment which is given by way of illustration and shown in the accompanying drawings, in which.

DESCRIPTION OF THE PREFERRED EMBODIMENT

Figure 1:
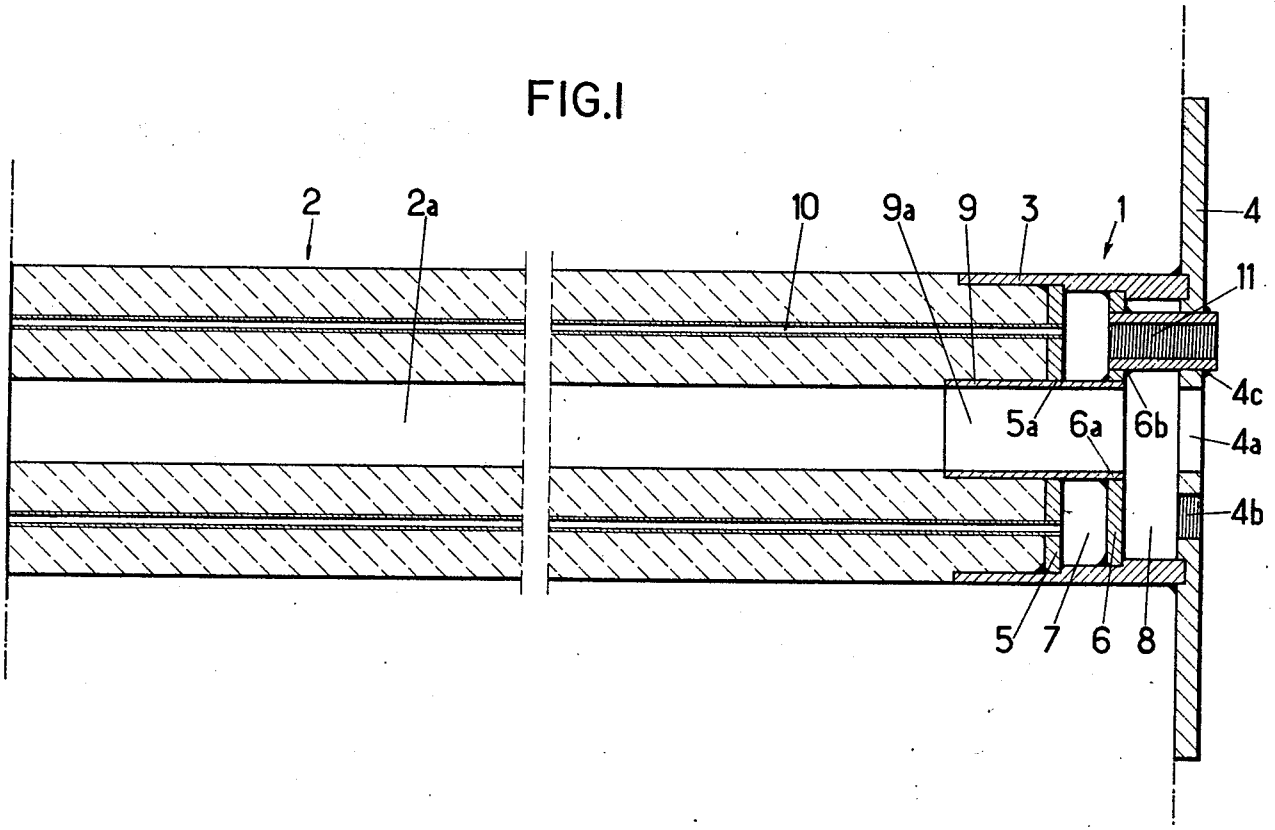
FIG. 1 is a longitudinal section through a preferred embodiment of the refractory guide tube according to the invention; and, FIG. 2 is a view similar to FIG. 1 and showing a modification thereof.

Referring to FIG. 1, a cylindrical refractory part 2 is illustrated as being fitted into a substantially cylindrical metal casing 1 and is provided with a central aperture 2a. Casing 1 comprises a cylindrical sleeve 3 to which a front plate 4, a molding plate 5 and a separating washer 6 are welded, members 4, 5 and 6 being parallel to one another and disc-shaped. Front plate 4, which has a central aperture **4*a* and is butt-welded to sleeve 3, acts as a bearing plate on the outer surface of the furnace wall. The molding plate 5, which has a central aperture 5*a*, is welded to the interior of sleeve 3. Washer 6, which has a central aperture 6*a* and is welded inside sleeve 3, is disposed between plates 4 and 5, between which it defines a first chamber 7 and a second chamber 8.**

A bushing 9 extends through chamber 7 between plate 5 and washer 6. Bushing 9 is butt-welded to washer 6 at **6*a* and connnects chamber 8 to the central aperture 2*a* of the refractory part 2. A threaded aperture 4*b* is provided in plate 4 so as to connect chamber 8 to a conventional compressed air source (not shown). The refractory part 2, which is partly embedded in sleeve 3 and is pressed on to the molding plate 5, contains a plurality of thin metal tubes 10, which are disposed around it at regular intervals. Tubes 10 are force-fitted into plate 5 and have their open ends in fluid communication with chamber 7. An internally threaded connecting tube 11 is welded to plate 4 at 4***c* and to washer 6 at 6*b* and extends through chamber 8 to supply chamber 7 with compressed air. Aperture 4*a* in plate 4, bore 9*a* in bushing 9 and central aperture 2*a* of part 2 have coaxial internal diameters so that a measuring rod (not shown) can travel through them.

Aperture 4*a* is smaller in diameter than bore 9a and central aperture 2*a;* these dimensions being selected so that the rod is guided as efficiently as possible while limiting to a minimum any leaks of cooling air along the front surface of the guide tube. It has been shown by experience, incidentally, that if a bushing 9 is not provided, the guide tube bore 2*a* becomes worn in a very random manner at the end of the campaign.

Owing to the preferred structure of the refractory guide tube, the measuring rod can be cooled separately from the refractory part of the guide tube. The refractory part 2, which is partially embedded in the casing 1 formed by chambers 7 and 8 and tubes 10, should have high mechanical and thermal strength. It is made e.g. of a mixture of 99% alumina and 1% binder melting between 1800° and 2000°C and molded in situ in casing 1. The refractory guide tube comprising casing 1 and refractory part 2 is adapted to be pressed into an aperture in a metallurgical furnace wall, without taking any special mechanical or thermal precautions, other than drying it in an oven, after which it is mechanically positioned so as to abut the outer surface of the furnace.

Casing 1 can be reused after a refractory guide tube has been worn out, if the melted thin metal tubes 10 are replaced by new tubes, which are likewise force-fitted into plate 5.

Of course, the embodiment which has been described can be changed, improved or added to in various ways, and certain elements therein can be replaced by equivalent elements without thereby departing from the general features of the invention.

Figure 2:
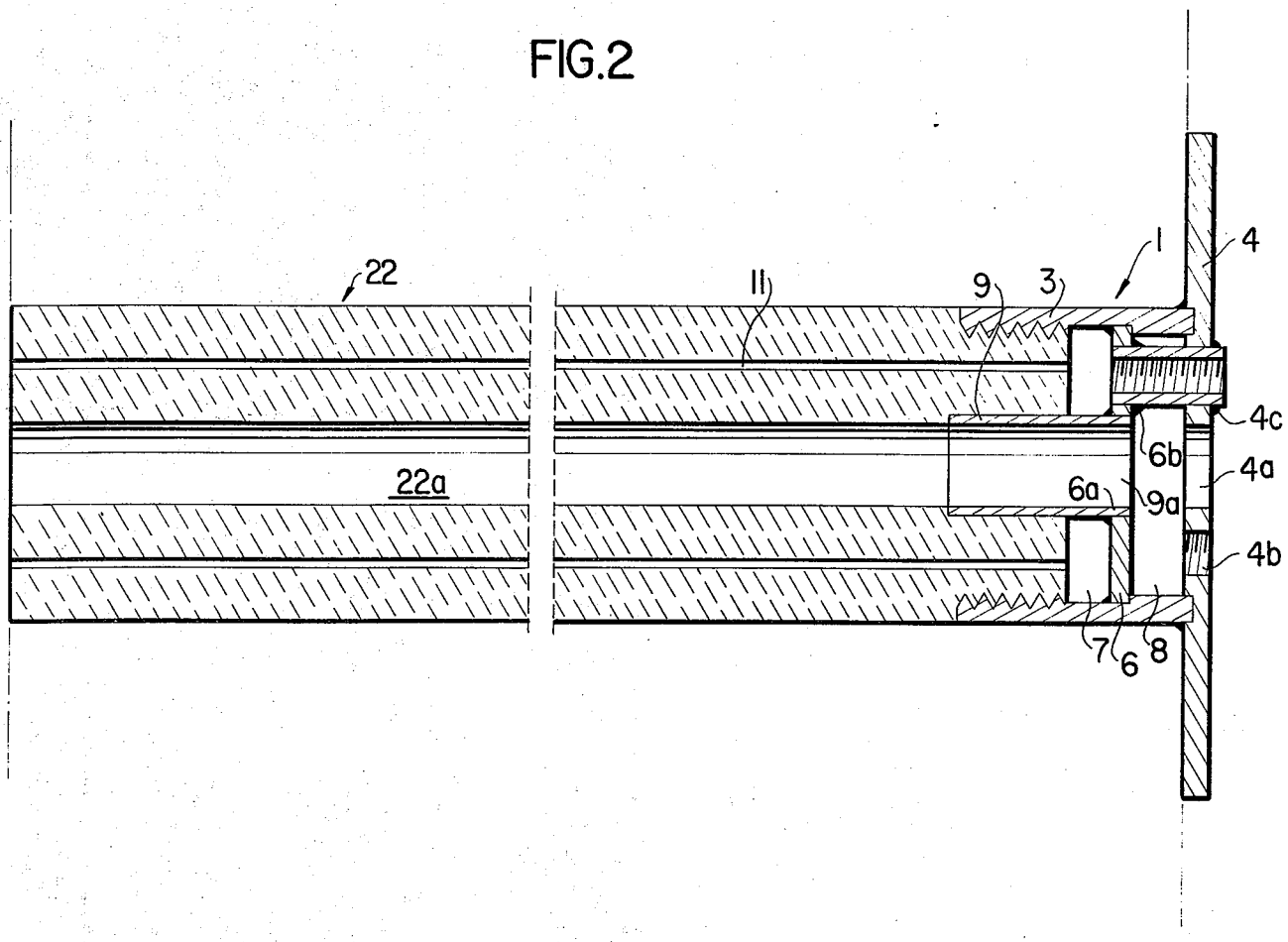

In one alternative embodiment shown in FIG. 2, for example, the ceramic member 22 can be manufactured separately by conventional ceramic molding means, in which case tubes 10 are replaced by apertures 11 formed directly by pins in the ceramic during molding. This embodiment has the advantage of eliminating the metal tubes 10, which results in a pressure loss at the end of the tube due to the air flowing therethrough diffusing through the porous ceramic material and improving the cooling of the mass. The loss of air by diffusion can easily be compensated for. The casing 1 can then be used indefinitely, with only the ceramic component 22 requiring replacement after use.

In the embodiment of FIG. 2, the ceramic component 22 is preferably threaded in tube 3 as shown in the drawing. Further, components 10 and plates 5 are omitted, which simplifies the construction of casing 1.

While I have disclosed and described preferred embodiments of my invention, I wish it understood that I do not intend to be restricted solely thereto but rather that I do intend to include all embodiments thereof which would be apparent to one skilled in the art and which come within the spirit and scope of my invention.

I claim:

1. In a guide tube assembly to be mounted in the wall of a metallurgical furnace for guiding an elongated rod member in intermittent penetrating movement into the cavity of the furnace for continuous measurement of the temperature of the wall, said guide tube assembly including a metal case of generally cylindrical configuration adapted to support an elongated substantially cylindrical refractory member having a centrally longitudinal opening extending therethrough aligned with an opening in the casing for receiving the elongated rod member, the improvement wherein said metal case comprises, an outer cylindrical sleeve, a front mounting plate welded onto one end of said outer sleeve, a molding plate mounted within said sleeve in inwardly-spaced relation to the other end thereof, a separating washer mounted within said outer sleeve intermediate said front plate and said molding plate, said separating washer cooperating with said sleeve and said front plate to define a first air chamber and with said sleeve and said molding plate to define a second air chamber, a first opening in said front plate concentric with said outer sleeve, said molding plate and said separating washer having central openings formed therein, a tubular guide sleeve having one end mounted in the central opening in said separating washer and projecting through the central opening in said molding plate, said guide sleeve being axially aligned with and having an inner diameter at least slightly greater than the diameter of said first opening in said front plate, said outer cylindrical sleeve, said molding plate, and said guide sleeve cooperating to define an annular recess for receiving and supporting one end of said refractory member with the central longitudinal opening therein in axial alignment with said guide sleeve and with the central opening in said front plate, first means for supplying air under pressure to said first air chamber and second means for supplying air under pressure to said second air chamber, a plurality of circumferentially spaced openings formed in said molding plate in outwardly spaced relation to said central opening therein, and a plurality of circumferentially spaced axially extending openings in said refractory member cooperating with said openings in said molding plate for permitting the flow of air from said second air chamber through said refractory support outwardly of said central longitudinal opening.

2. The guide tube assembly as defined in claim 1 further comprising a plurality of elongated metal tubes mounted one in each of said circumferentially spaced openings in said molding plate, said metal tubes extending longitudinally through said refractory member outwardly from said longitudinal opening therein.

3. The guide tube assembly defined in claim 2 wherein said means supplying air to said first chamber comprises a second opening formed in said end plate in spaced relation to said central opening and communicating with said first air chamber, and wherein said means providing air under pressure to said second chamber comprises a tubular member extending through said front wall and said separating washer.

4. The guide tube as defined in claim 3 wherein said front plate extends radially outward beyond said outer cylindrical sleeve to thereby form a mounting flange adapted to abut the outer wall of a metallurgical furnace.

* * * * *